United States Patent [19]

Crandell

[11] Patent Number: 4,768,321

[45] **Date of Patent: * Sep. 6, 1988**

[54] GLAZING SYSTEM

[75] Inventor: Stephen L. Crandell, Gibsonia, Pa.

[73] Assignee: PPG Industries, Inc., Pittsburgh, Pa.

[ * ] Notice: The portion of the term of this patent subsequent to Dec. 29, 1998 has been disclaimed.

[21] Appl. No.: 28,079

[22] Filed: Aug. 15, 1986

Related U.S. Application Data

[60] Continuation of Ser. No. 733,153, May 13, 1985, abandoned, which is a continuation of Ser. No. 648,855, Sep. 7, 1984, Pat. No. 4,625,481, which is a division of Ser. No. 311,822, Oct. 16, 1981, Pat. No. 4,483,122, which is a continuation-in-part of Ser. No. 65,318, Aug. 9, 1976, Pat. No. 4,307,551.

[51] Int. Cl.[4] ..... E04B 2/88

[52] U.S. Cl. ..... 52/235

[58] Field of Search ..... 52/586, 202, 203, 235, 52/344, 470–472, 475, 506, 508–512, 772, 778, 779

[56] References Cited

U.S. PATENT DOCUMENTS

| | | | |
|---|---|---|---|
| Re. 30,432 | 11/1980 | Stoakes | 52/395 |
| 974,310 | 11/1910 | Thompson | 52/461 |
| 2,145,469 | 1/1939 | Weinland | 52/235 |
| 2,392,190 | 1/1946 | Downes | 52/202 |
| 3,082,848 | 3/1963 | Keller | 52/235 |
| 3,251,168 | 1/1967 | Waring | 52/235 |
| 3,295,282 | 1/1967 | Belcher, Jr. | 52/235 |
| 3,559,358 | 2/1971 | Lohse et al. | 52/235 |
| 3,672,107 | 6/1972 | Santry et al. | 52/511 |
| 3,712,016 | 1/1973 | Reeve | 52/741 |
| 3,715,848 | 2/1973 | Jordan | 52/235 |
| 3,735,544 | 7/1973 | Longinotti | 52/235 |
| 3,936,986 | 2/1976 | Steel | 52/235 |
| 3,967,424 | 7/1976 | Gates | 52/511 |
| 3,978,633 | 9/1976 | Scheidler et al. | 52/511 |
| 4,015,388 | 4/1977 | Hemminger | 52/395 |
| 4,055,923 | 11/1977 | Biebuyck | 52/235 |
| 4,056,904 | 11/1978 | Dowdy | 52/127.3 |
| 4,070,835 | 1/1978 | Revérend et al. | 52/126.1 |
| 4,089,146 | 5/1978 | Martinez | 52/484 |
| 4,107,887 | 8/1978 | Wendt | 52/235 |
| 4,121,396 | 10/1978 | Oogami et al. | 52/235 |
| 4,307,551 | 12/1981 | Crandell | 52/235 |
| 4,324,373 | 4/1982 | Zibritosky | 52/208 |
| 4,370,838 | 2/1983 | Vermillion | 52/36 |
| 4,372,901 | 2/1983 | Kim | 52/309.7 |
| 4,448,001 | 5/1984 | Whitmyer | 52/235 |
| 4,483,122 | 11/1984 | Crandell | 52/235 |
| 4,545,161 | 10/1985 | Baumann | 52/235 |
| 4,581,868 | 4/1986 | McCann | 52/235 |
| 4,625,481 | 11/1984 | Crandell | 52/747 |

FOREIGN PATENT DOCUMENTS

| | | | |
|---|---|---|---|
| 675036 | 11/1963 | Canada | 52/235 |
| 2216214 | 10/1973 | Fed. Rep. of Germany | 52/235 |
| 2738748 | 1/1979 | Fed. Rep. of Germany | 52/235 |
| 1014857 | 12/1965 | United Kingdom | 52/235 |
| 2126620 | 7/1983 | United Kingdom . | |
| 2142357A | 1/1985 | United Kingdom . | |

OTHER PUBLICATIONS

Reinhold Publishing Co., Third Printing 1958, "The Condensed Chemical Dictionary", p. 981, silicone.

"Qasal® Exterior Building Panels" Glassweld Sweets Architectural Catalog.

Kawneer drawings SK-1 through SK-5.

Advertisement from Alumiline, 3500 Series Structural Glazing.

"Architectural Glazing" Architectural Division of Lord & Burnham Company, Limited.

Kawneer Product Bulletin 84-DP-19, Oct. 31, 1984.

*Primary Examiner*—John E. Murtagh

*Assistant Examiner*—Andrew Joseph Rudy

*Attorney, Agent, or Firm*—Donald Carl Lepiane

[57] ABSTRACT

A method of replacing damaged panels of a cladding system includes the use of a replacement panel. The replacement panel includes a sheet having a side hanger secured to a major surface of the sheet at each of opposed sides of the sheets and extending beyond their adjacent side of the sheet and a bottom hanger secured to the major surface of the sheet adjacent bottom edge of the sheet and having an exterior facing groove. After the damaged panel is removed, an opening is provided defined by the top hanger of the removed panel, vertical splines and a horizontal spline. The exterior groove of the bottom hanger is mounted on the horizontal spline and the panel tilted in position against adhesive provided on outer surface of top hanger. Extending portions of the side hangers are screw fastened to underlying ones of the vertical splines. Thereafter, the space between the previously installed panel and replacement panel is filled with a layer of silicone.

7 Claims, 7 Drawing Sheets

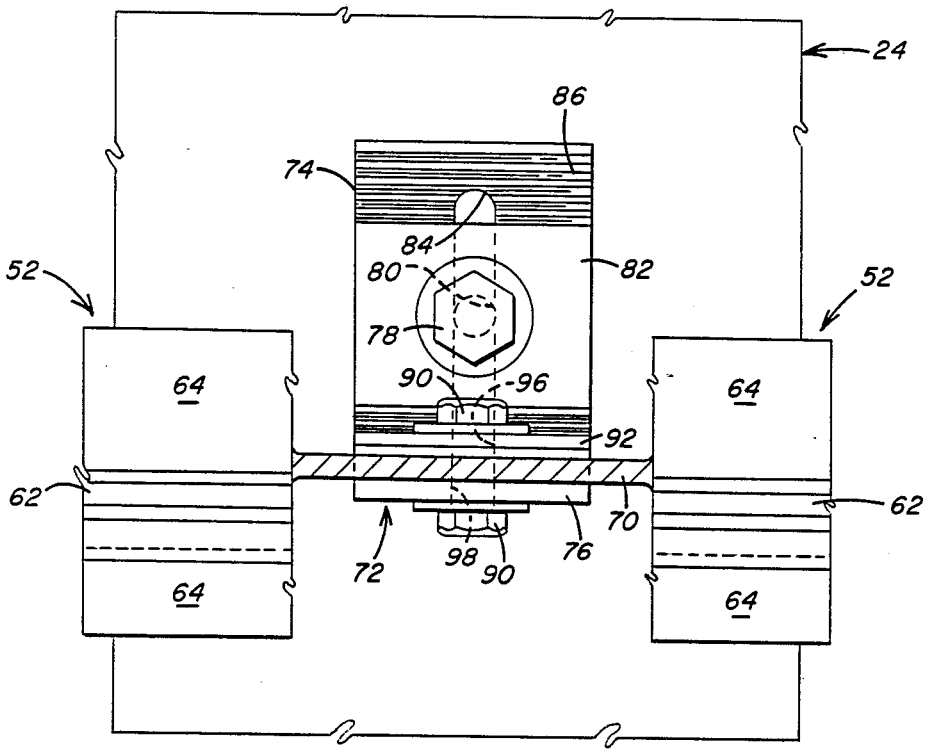
FIG. 4
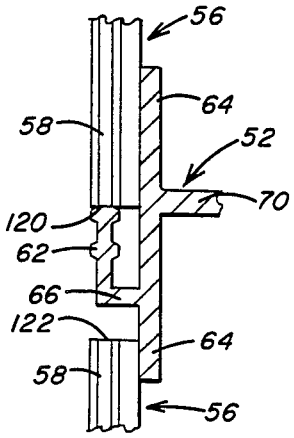
FIG. .8

GLAZING SYSTEM

RELATED APPLICATIONS

This application is a continuation of application Ser. No. 733,153, filed May 13, 1985, now abandoned, which is a continuation of application Ser. No. 648,855 filed Sept. 7, 1984, which is a division of application Ser. No. 311,822, filed Oct. 16, 1981, now U.S. Pat. No. 4,483,122, which is a continuation-in-part of application Ser. No. 65,318 filed Aug. 9, 1976, since issued as U.S. Pat. No. 4,307,551.

BACKGROUND OF THE INVENTION

1. Field of the Invention

This invention relates to a method of installing replacement panels in a cladding attached to a building exterior and to the replacement panels.

2. Background Discussion

Increased cost of materials and labor have made it economical to clad the exterior of buildings with panels rather than raze the building and build a new one. An acceptable cladding system usually has (1) vertical and horizontal panel supporting members that are easily assembled and attached to the exterior building wall to form a panel supporting grid and (2) panels that are easily mounted on the supporting grid and secured in position. Such a ciadding system is taught in the abovemeLtioned U.S. Pat. application Ser. No. 65,318.

With the availability of an acceptable cladding system, it would now be advantageous to provide replacement panels and a method of using same to replace selected panels, e.g., damaged panels.

SUMMARY OF THE INVENTION

This invention relates to a panel for replacing a broken panel of a cladding system. The panel includes a sheet, e.g., a glass sheet or a plurality of sheets joined together, e.g., a multiple glazed unit. A side hanger is secured on major surface of the sheet adjacent one side of the sheet and extends outwardly from the side. A hanger is also secured on the major surface of the sheet adjacent the bottom edge. The bottom hanger has an exterior facing groove.

This invention also relates to a method of replacing selected panels of a cladding system by removing the panel to be replaced to provide an opening. In one embodiment, the replacement panel discussed above is mounted in the opening by positioning its bottom hanger on horizontal spline defining the bottom edge of the opening, and is biased into the opening against a layer of adhesive on a top hanger defining the upper edge of the opening. Thereafter, the extending portions of the side hangers are secured, e.g., by screws to the vertical spline defining sides of the opening. In another embodiment, hangers having an adhesive layer are mounted around the opening afterwhich a sheet is mounted in the opening and urged against the hangers to adhere the sheet to the adhesive thereby securing the sheet to the hangers.

BRIEF DESCRIPTION OF THE DRAWING

FIG. 4 is a partial front view having portions removed for purposes of clarity to illustrate the anchor of the support system;

FIG. 8 is a partial side view illustrating the relative position of vertical hanger support member and horizontal hanger support member or furring of the support system;

DESCRIPTION OF THE INVENTION

The instant invention relates to replacement panels and method of installing same that may be used in replacing selected panels, e.g., damaged panels in a cladding system. Although not limiting to the invention, the invention is practiced on the cladding system taught in the above-mentioned U.S. patent application Ser. No. 65,318, filed Aug. 9, 1979, which teachings are hereby incorporated by reference. The following is a general description of the cladding system and reference may be had to U.S. patent application Ser. No. 65,318 for a more detailed description.

Figure 1:
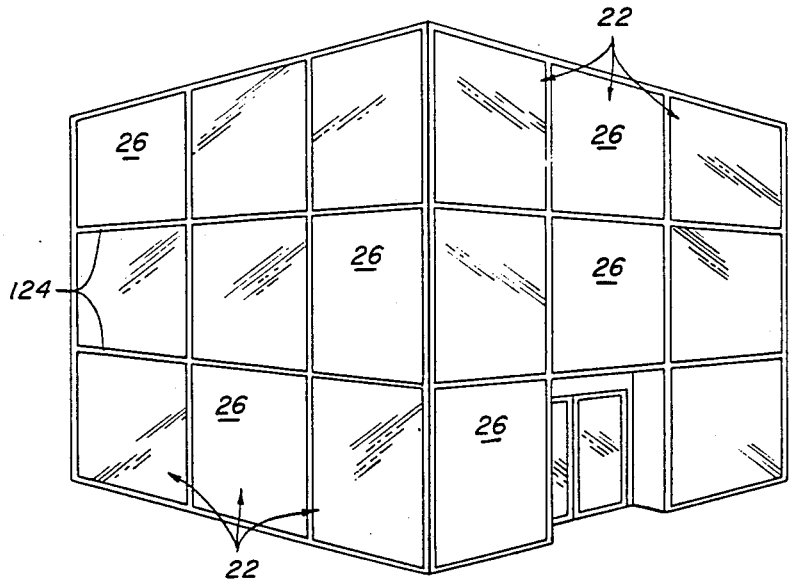
FIG. 1 is a perspective view of a cladded building.
Figure 6:
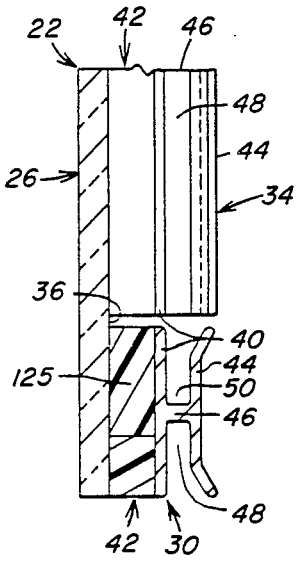
FIG. 6 a view taken along lines 6—6 of FIG. 5.
Figure 5:
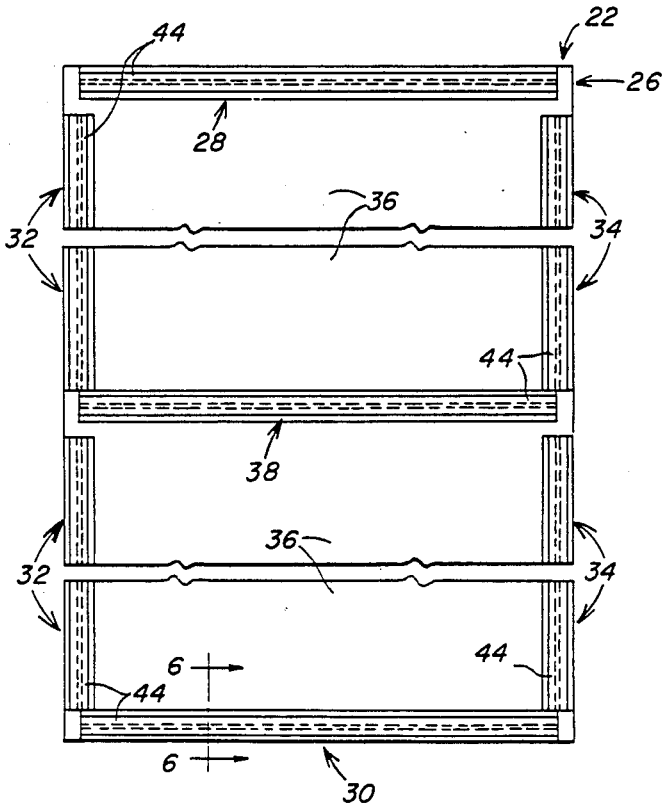
FIG. 5 is the inside view of a panel showing the relative position of hangers for mounting the panel on the support system.
Figure 2:
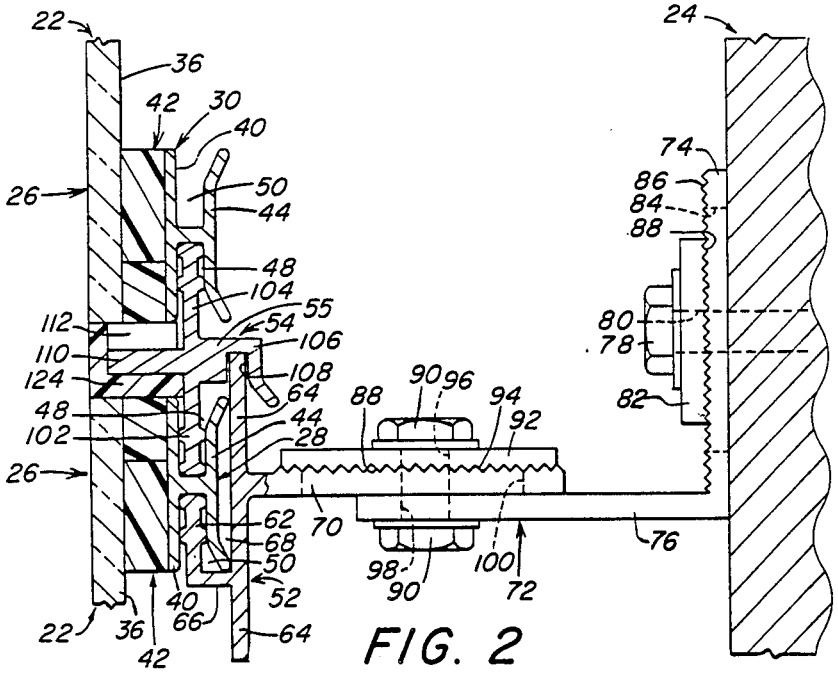
FIG. 2 is a side view of a panel support system for securing panels in position in spaced relationship to a building exterior.

Shown in FIG. 1 is building 20 having outer panels 22 mounted to former exterior walls 24, a portion of which is shown in FIGS. 2 and 4. With reference to FIG. 5, each of the panels 22 include a sheet 26 having a top hanger 28, a bottom hanger 30 and side hangers 32 and 34 secured to the interior surface 36 of the sheet 26. An intermediate hanger 38 may be used to minimize bowing of the center portion of the sheet and provide additional structural stability to the mounted sheet. With reference to FIG. 6, the hangers 28, 30, 32, 34 and 38 are identical in construction and each include a base 40 secured in any convenient manner, e.g., by adhesive layer 42 to the interior surface 36 of the sheet 26. A facing member 44 is spaced from the base 40 by leg 46 to provide an exterior groove 48 and an interior groove 50.

Figure 7:
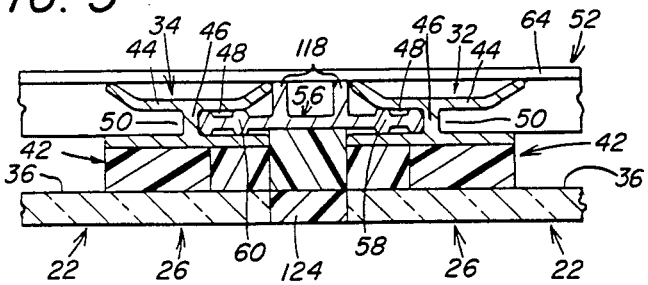
FIG. 7 is a partial top elevated view having portions removed for purposes of clarity illustrating the vertical hanger support members or splines of the support system.

Referring back to FIG. 2, the interior groove 50 of the top hanger 28 of the bottom panel 26 as shown in FIG. 2 is mounted on horizontal panel supporting member or furring 52. Horizontal spline 54 is mounted in the exterior groove 48 of the top hanger 28 of the bottom panel 26 and in the exterior groove 48 of the bottom hanger 30 of the adjacent top panel 26 as viewed in FIG. 2. With reference to FIG. 7, the exterior groove 48 of the side hangers 32 and 34 are mounted on a vertical panel supporting member or spline 56 to be discussed below. The downwardly facing groove of the intermediate hanger 38 of the panel 26 as mounted is mounted on a horizontal furring 52 in a similar manner as the top hanger 28 of the bottom panel as viewed in FIG. 2. As can now be appreciated, the hangers 30, 32, 34 and 38 do not use both the interior and exterior grooves 50 and 48 respectively. However, to avoid confusion when securing the hangers on the back of the sheet, it is recommended that the hangers have similar construction.

Referring back to FIG. 5, the top hanger 28, the bottom hanger 30 and intermediate hanger 38 have their ends spaced inwardly from the sides of the sheet so that the exterior groove 48 of the side hangers 32 and 34 can receive outward extensions 58 and 60 respectively of the vertical spline 56 as shown in FIG. 7. The top hanger 28 and intermediate hanger 38 are spaced from adjacent ends of the side hangers 32 and 34 so that hanger support extension 62 of the horizontal furring 52 can be inserted in the interior groove 50 of the top and intermediate hanger as shown for the top hanger 28 of the bottom panel 26 as viewed in FIG. 2.

With reference to FIG. 2, the horizontal furring 54 is preferably a continuous piece having a generally "J" shaped cross-section. The hanger support extension 62 of the furring 52 is connected to spline support 64 and spaced therefrom by spacing member 66 to provide an upward extending groove 68 for mating the extension 62 of the horizontal furring 52 with the top hanger 28. Beam 70 attached to the spline support 64 qf the furring 52 is secured to a plurality of spaced anchors 72 (one shown in FIGS. 2 and 4) to mount the horizontal furring 52 in spaced relation to tHe former exterior wall 24 of the building 20.

As viewed in FIGS. 2 and 4, the anchor 72 has a vertical arm 74 mounted to the building exterior 24 and a horizontal arm 76 fastened to the beam 70 of the horizontal furring 52. A bolt 78 passing through hole 80 in rectangular washer 82 and slot 84 in the vertical anchor arm 74 is threaded into the building wall 24. The vertical anchor arm 74 and washer 82 have engaging serrated surfaces 86 and 88, respectively, to prevent vertical displacement of the anchor 72 from the dead weight of the panels and/or horizontal and/or vertical furring. The slot 84 in the vertical anchor arm 74 provides for vertical adjustment of the anchor 72 afterwhich the bolt 78 is tightened to secure the anchor 72 in position. The beam 70 of the horizontal furring 52 is secured to the horizontal anchor arm 76 by bolt and nut assembly 90 and washer 92. Serrated surface 98 of the washer 92 mates with serrated surface 94 of the beam 70 and slot 100 of the beam 70 to provide for horizontal adjustment of the furring 52.

As viewed in FIG. 2, the horizontal spline 54 has a bottom extension 102 insertable in exterior groove 48 of the top hanger 28 of the bottom panel and an upper extension 104 insertable in exterior groove 48 of the bottom hanger 30 of the upper panel. A stabilizing arm 106 has groove 108 for receiving end of the spline support 64 of the horizontal furring 52. An outwardly extending support ledge 110 is provided at sel[cted intervals on the horizontal spline 54 for supporting spacer blocks 112 (only one shown in FIG. 2) which support bottom edge of the panel 26 as mounted to minimize stress on the adhesive layer 42 of the top, bottom and intermedite hangers.

Figure 3:
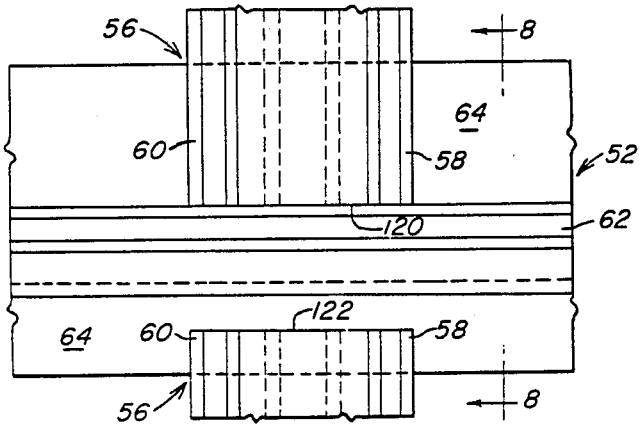
FIG. 3 is a partial front view of the panel support system having the panels removed to show the side or vertical hanger members or splines of the support system.

As shown in FIG. 7, the vertical spline 56 includes the extending side arms 58 and 60 and spacing fingers 118 for aligning the side arms 58 and 60 with (1) the extensions 102 and 104 of the horizontal spline 54 and (2) the exterior groove 48 of the side hangers 32 and 34 of adjacent panels 22. As shown in FIGS. 3 and 8, the bottom end 120 of the vertical spline 56 rests on the hanger support extension 62 and on outer surface of the spline support 64 of the horizontal furring 52 as clearly shown in FIG. 8. Upper end 122 of the vertical spline 56 rests on the outer surface of the spline support 64 under the spacing member 66 of horizontal furring 52 as shown in FIG. 8. The vertical spline 56 may be held in position by fastening the ends to the horizontal furring 52 or may rest unfastened on the furring 52 as discussed. The vertical spline 56 minimizes or eliminates center and/or end bowing of the panels.

After the panels are secured in position, the spacing or recess between the panels may be filled with an adhesive layer or sealant 124 to minimize dust and moisture penetration between the panels. The exposed outer edges of the cladding system, e.g., at the corners may be finished in any convenient manner, e.g., by a metal channel.

As can now be appreciated, the sheet 26 may be a glass sheet, metal sheet, a multiple glazed unit, or wooden sheet, which, in turn, may be coated or uncoated as well as combinations thereof.

In general, the cladding system discussed above may be constructed in the following manner. Referring back to FIG. 5, the hangers 28, 30, 32, 34 and 38 are secured to interior surface 36 of the sheet 26 by an adhesive layer 42 which includes a spacer tape 125 having opposed adhesive surfaces and a bead 126 of adhesive. The top hanger 28 is mounted an the interior sheet surface 36 flush with the top edge of the sheet, the bottom hanger 30 is mounted on the sheet surface 36 flush with the bottom edge of the sheet as mounted and the intermediate hanger 38 is mounted on the sheet surface between the top and bottom hangers. The ends of the hangers 28, 30 and 38 are spaced from adjacent sides of the sheet as mounted. Side hangers 32 and 34 are mounted on the sheet surface 36 in a similar manner as the top, bottom and intermediate hangers. The side hangers 36 are flush with their respective sides of the sheet. The pair of side hangers between the top hanger 28 and intermediate hanger 38 have their upper end as viewed in FIG. 5 spaced from the top hanger. The pair of side hangers 32 and 34 between the bottom hanger 30 and intermediate hanger 38 have their upper end as viewed in FIG. 5 spaced from the intermediate hanger 38.

With reference to FIGS. 2 and 4, anchors 72 are mounted on the exterior of the building 24 at selected intervals by a bolt 78 passing through the hole 80 in the rectangular washer 82 and slot 84 in the leg 74 into the building wall 24. With reference to FIG. 2, the beam 70 of the horizontal furring 52 and horizontal leg 76 of the anchor are held together by a nut and bolt assembly 90 and washer 92 as shown in FIG. 2.

The interior groove 50 of the top hanger 28 and bottom groove 50 of the intermediate hanger receive the hanger support extension 62 of a horizontal furring. The bottom hanger 30 of the bottommost mounted panels as shown in FIG. 1, may be mounted on the extension 62 of the horizontal furring 52 (see FIG. 2) or vertical leg of metal angle (not shown) secured in position at the sidewalk level.

With reference to FIGS. 3, 7 and 8, after a panel is mounted at the lowermost bottom corner, the extension arm 58 or 60 of a vertical spline 56 is moved between adjacent horizontal furrings 52 into exterior groove 48 of the side members 32 or 34 at one side of the panel. The length of the vertical spline 56 is sufficient to have its end 122 mounted below the arm 66 and against spline support 64 of the horizontal furring 52 while the bottom end 120 rests on the vertical support 62 as shown in FIG. 8.

With reference to FIG. 2, after the bottommost row of panels are in position, a horizontal spline 54 is mounted in the exterior groove of the top hanger 28 of the mounted panels and on the spline support 64 of the horizontal furring 52. The length of the horizontal spline 54 is approximately the same length as the top hanger. A pair of spacer blocks 112 are mounted on the ledge 110 of the furring 52. A second row of panels are mounted by placing the exterior groove 48 of the bottom hanger 30 on the upper extension 104 of the horizontal spline 54. The intermediate and top hanger are mounted on the horizontal furring 52 as previously discussed. Vertical splines 56 are provided between the panels as previously discussed. The above is repeated until the walls of the building are clad.

With reference to FIG. 7, an open-cell polyurethylene backer 127 is provided in the recess between adjacent panel edges afterwhich a layer or bead 124 of silicone is flowed in the recess between adjacent edges of the mounted panels. The exterior edge portions of the system, e.g., at the corners and top are dressed in any convenient manner.

Figure 10:
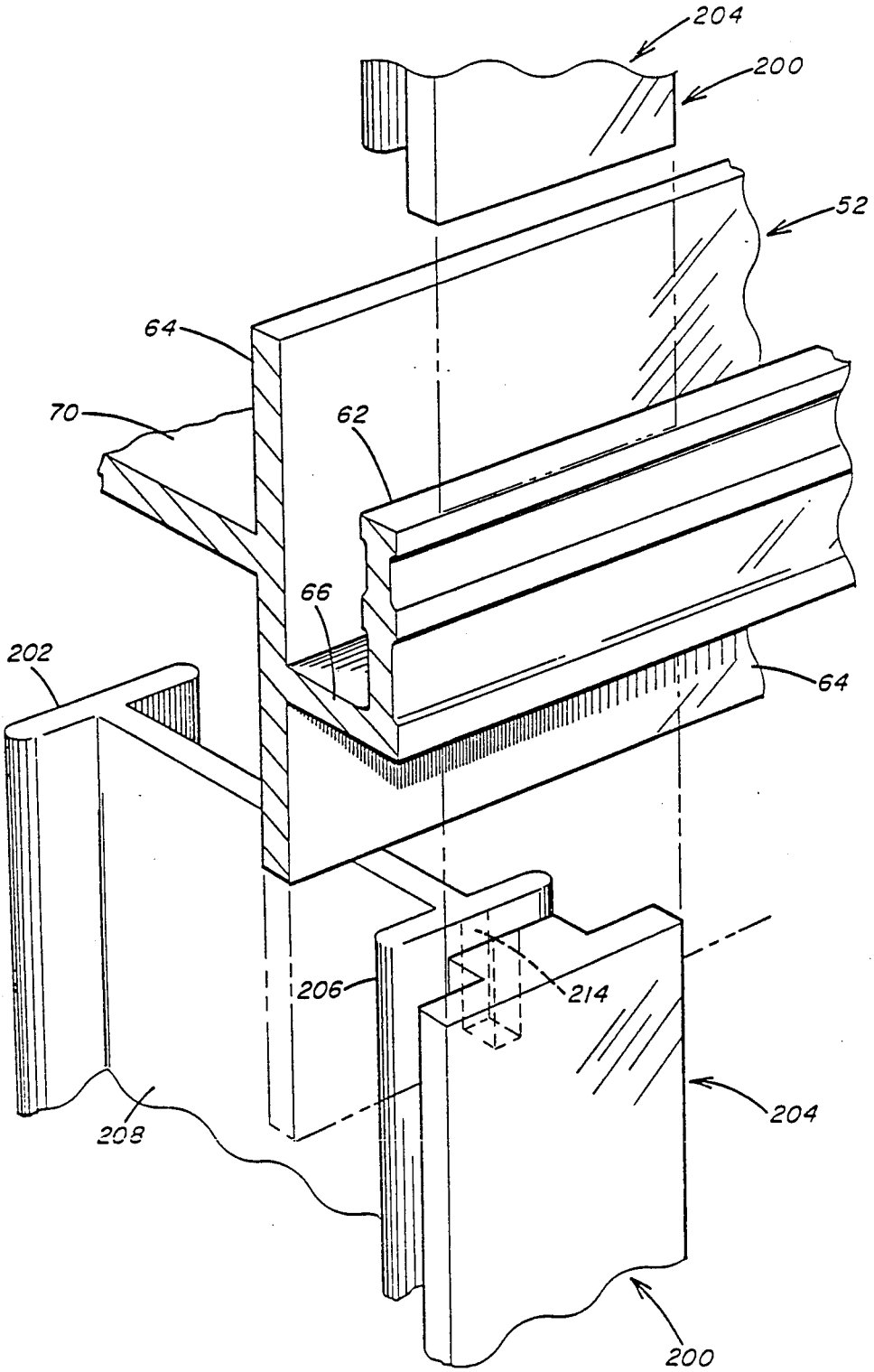
FIG. 10 is an isometric view of an alternate embodiment of a vertical hanger support member and the horizontal hanger support member in a preassembled relationship.
Figure 11:
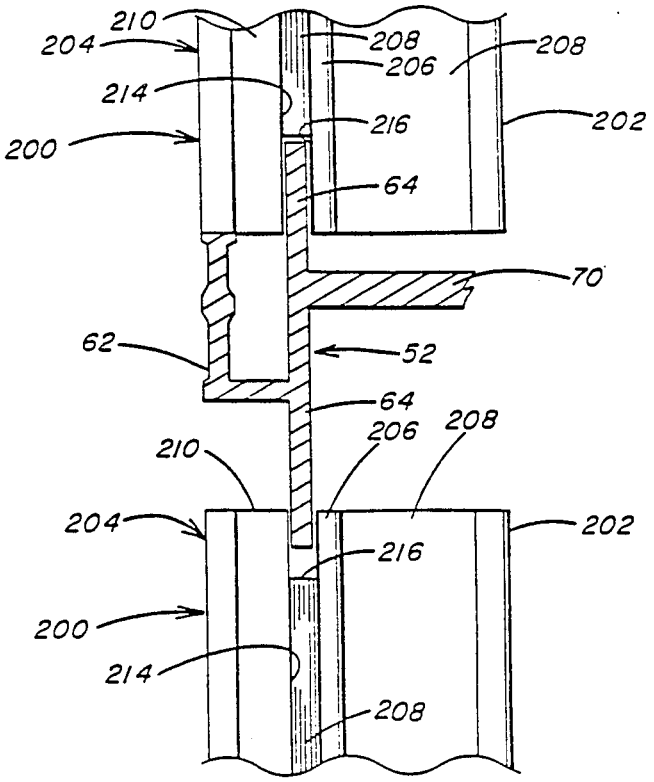
FIG. 11 is a view similaF to the view of FIG. 8 showing an alternate embodiment of a vertical hanger support member.
Figure 12:
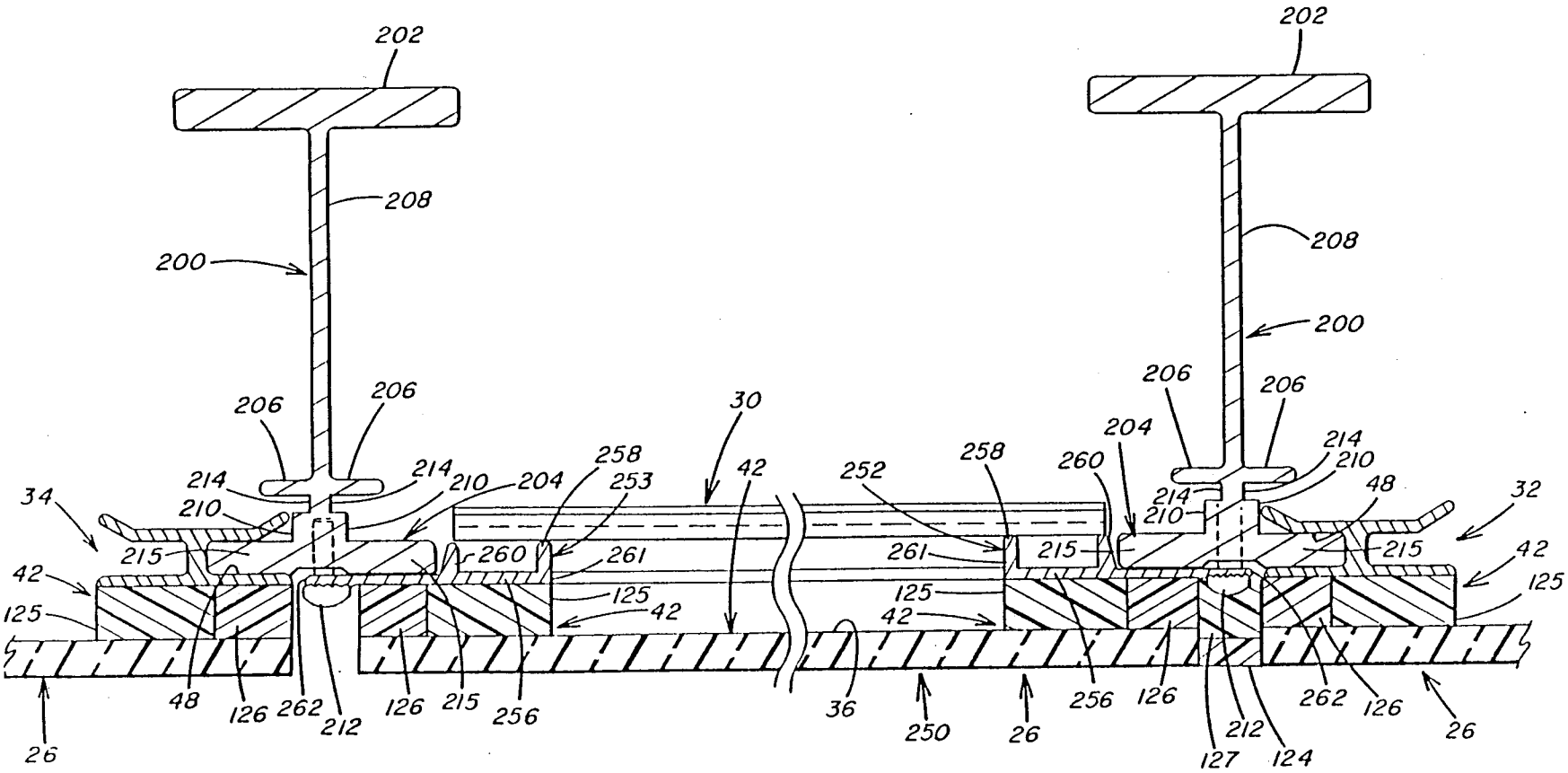
FIG. 12 is a partial top elevated view having portions removed for purposes of clarity illustrating a replacement panel incorporating features of the invention secured in accordance with the teachings of the invention in an opening provided by removing the initial pjnel.

In FIGS. 10–12, there is shown another type of vertical spline which is within the scope of the teachings of the above-mentioned U.S. patent application Ser. No. 65,318 and is now discussed in detail. Vertical spline 200 includes a first or inside plate 202, a second or outside plate 204 and an intermediate plate 206 held in a fixed spaced relation by a web 208. The outside plate 204 has an enlarged portion or shoulder 210 for receiving securing screws 212 to be discussed below and to form a pair of opposed recesses 214 with the intermediate plate 206. The outside plate 204 and shoulder 210 are sized to insert the end portion 215 of the outside plate 204 into adjacent exterior groove 48 of adjacent side hanger 32 or 34 as shown in FIG. 12. The recesses 214 are sized to about the thickness of the spline support 64 of the furring 52. In this manner and as shown in FIGS. 10 and 11, removing end portions of the web 214 between the intermediate plate 206 and shoulder 210 of the outside plate 204 provide a cut out portion 216. The cut out portion 216 at the ends of the vertical spline 200 receive the spline 64 of adjacent spaced furrings 52 while resting on the hanger support extension 62 to prevent motion toward and away from the building 24 (shown in FIG. 2). The web 208 and plates 202, 204 and 206 provide a more structurally stable vertical spline.

In practice, after the first panel of the bottommost row is mounted in position, the vertical spline 200 is angled between spaced adjacent horizontal furrings 52. With reference to FIG. 11, the cut out portion 216 at the bottom end of the vertical spline 200 is mounted on the upper spline support 64 of the furring 52. Thereafter, the vertical spline 200 is uprighted to move the cut out portion 216 at the upper end of the vertical spline 200 to receive the bottom spline support 64 of the furring 52. The vertical spline is then moved to insert the end portion 214 of the outside plate 204 into the exterior groove 48 of a side hanger 32 or 34. In position, the bottom end of the vertical spline rests on the hanger support extension 62 of the furring 52 as shown in FIG. 11.

Figure 9:
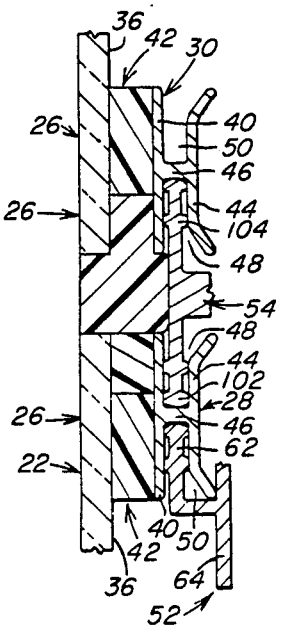
FIG. 9 is a partial side view similar to the view in FIG. 2 illustrating a panel replaced in accordance with the teachings of the invention.

In general, and in accordance with the teachings of the invention, selected panels, e.g., damaged panels are replaced by removing the silicone 124 and backer 127 (see FIG. 7) around the damaged unit and the hangers. New or cleaned old hangers are mounted in place of the removed hangers. Double backed tape 125 (see FIG. 9) is mounted on the hangers, afterwhich a sheet 26 is mounted on the support blocks 112 (see FIG. 2) and urged against the tape 125. Thereafter, a layer 124 of silicone is applied around the newly installed sheet and flowed between the base 40 of the hanger, e.g., the hanger 30 shown in FIG. 9 and interior surface of the sheet and into the recess between adjacent panels as shown in FIG. 9. As can be appreciated, the removal of the hangers from the opening depends on the ease with which the hangers can be removed. For example, and with continued reference to FIG. 9, the top hanger 28 is captured between the horizontal furring 52 and the bottom 102 of the horizontal spline 54 and is difficult to remove whereas the side hangers 32 and 34, bottom hanger 30 and intermediate hanger 38 are easily removed. It may be preferred in this instance, to leave the top hanger 28 of the removed panel in position. The top hanger would be cleaned in position and thereafter a piece of double backed tape 125 is mounted on the base 40 of the top hanger 28.

Figure 13:
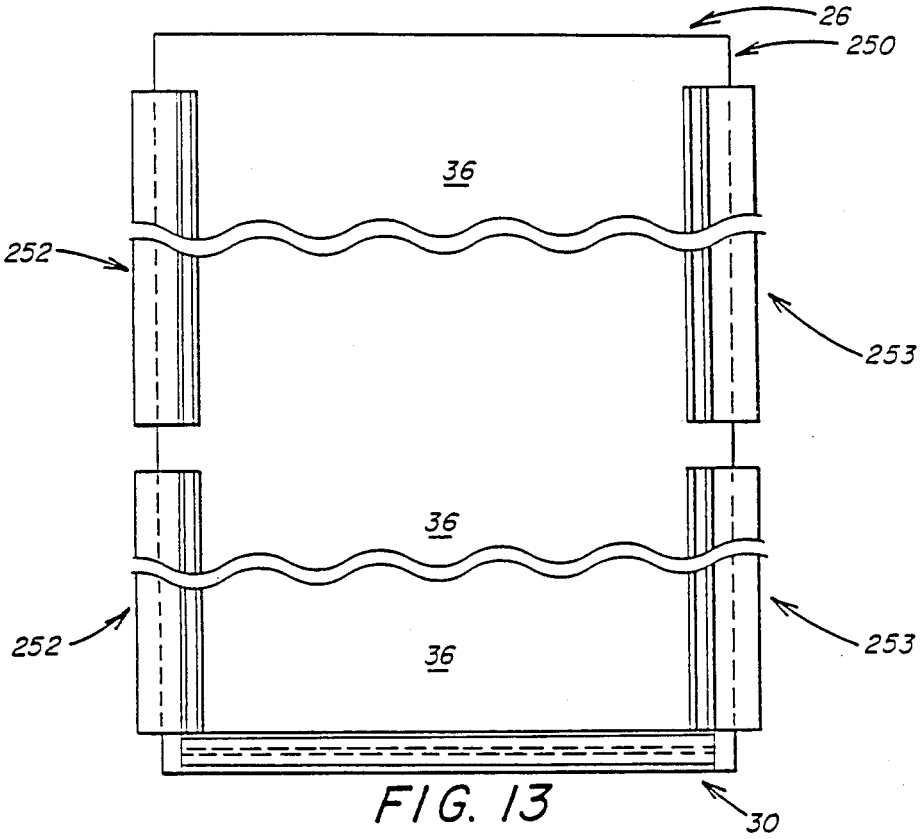
FIG. 13 is the inside view of a replacement panel incorporating features of the invention illustrating the relative position of hangers for mounting the panel in a cladding system.

Shown in FIG. 13 is a replacement panel 250 incorporating features of the invention. The panel 250 includes the sheet 26 having a bottom hanger 30 and side hangers 252 and 253 conveniently secured to the interior surface 36 of the sheet 26. The replacement panel 250 does not have a top hanger 28 nor intermediate hanger 38 secured to the interior sheet surface 36. As discussed below, these hangers will be premounted in the opening provided by removing the damaged panel. To accommodate the premounted intermediate hanger, the ends of adjacent side hangers 252 and 253 are spaced from one another and to accommodate the premounted top hanger, the top end of uppermost hangers 252 and 253 are spaced from the top edge of the sheet 26 as viewed in FIG. 13. As can be appreciated, if the previously removed panel had no intermediate hanger, the side hangers 252 and 253 at each side would preferably be continuous.

Figure 14:
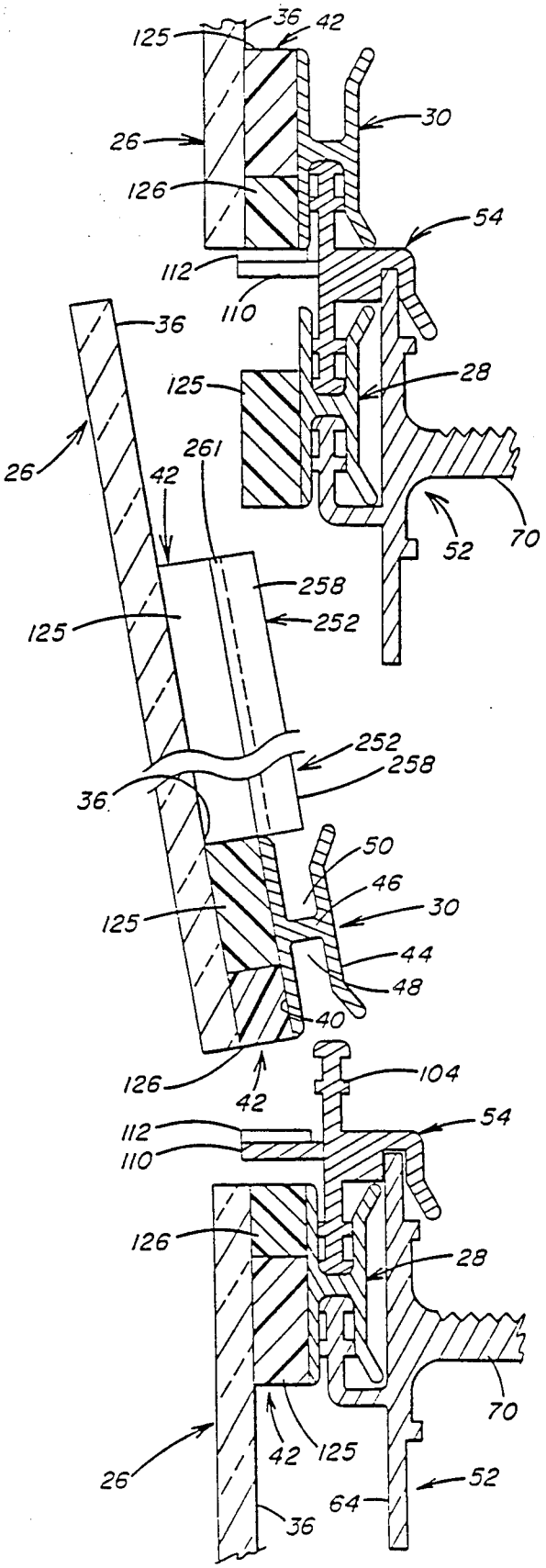
FIG. 14 is a side elevated view illustrating the insertion of a replacement panel incorporating features of the invention into an opening prepared in accordance to the invention in the cladding system shown in preceeding FIGS.
Figure 15:
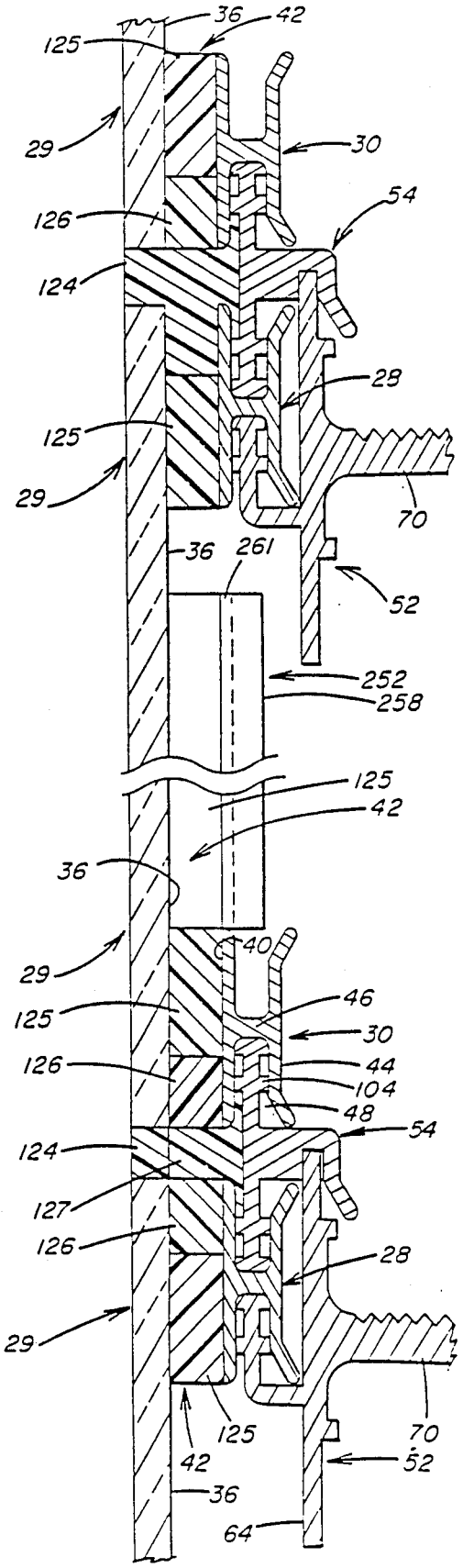
FIG. 15 is a partial side view having portions removed for purposes of clarity illustrating the replacement panel secured in the opening.

The following is a detailed description of a replacement panel that may be used in the cladding system taught in the above-mentioned U.S. patent application Ser. No. 65,318. A sheet 26 having a width of about 6 feet (1.8 meters), a length of about 8 feet (2.4 meters) and a thickness of about ¼ inch (0.64 centimeters) has a bottom hanger 30 having a length of about 5 feet, 10¼ inches (1.78 meters) and four side hangers 252 and 253 each having a length of about 3 feet, 9-1/16 inches (1.15 meters) conveniently secured to the interior sheet suface 32 by adhesive layer 42. The bottom hanger 30 as shown in FIGS. 14 and 15 has an "H" shaped cross-section and includes a base 40 having a height of about 1.375 inches (3.5 centimeters) and a facing member 44 having outward sloping ends and a height of about 1.375 inches (3.5 centimeters) spaced from the base 40 by leg 46 to provide an exterior groove 48 and interior groove 50 each having a width of about 0.250 inch (0.64 centimeter). The thickness of the base 40, facing member 44 and leg 46 is about 0.068 inch (0.17 centimeter). The side hangers 252 and 253 as shown i[FIG. 12 having a main body portion 256 with two spaced upwardly extending [ins 258 and 260 giving the side hangers a general "F" shape cross-sectional configuration. The body portion has a width of about 1.75 inches (4.45 centimeters) as measured between side 261 and 262. The fins 258 and 260 are on a center to center spacing of about ¾ inch (1.91 centimeters) and each have an extending length of about ¼ inch (0.64 centimeter). The end 261 of the side hangers 252 and 253 extend about ⅞ inch (2.22 centimeters) beyond the adjacent side of the sheet 26 to provide a screw receiving portion for receiving the screw 212.

The hangers 30, 252 and 253 are secured to interior surface 36 of the sheet 26 by an adhesive layer 42 which includes (1) a tape 125 of the type sold by Norton Company of Granville, N.Y., P-2112×⅞ inch (2.2 centimeters) and (2) a ⅜ inch (0.9 centimeter) high, ½ inch (1.27 centimeter) wide, bead 124 of silicon of the type sold by Dow Corning of Midland, Mich. As shown in FIGS. 14 and 15, the bottom hanger 30 is mounted on the interior sheet surface 36 flush with the bottom edge of the sheet as mounted. The ends 261 of the hangers 252 and 253 as shown in FIG. 12 are mounted on the sheet surface 36 and extend about ⅜ inch (0.95 centimeter) beyond their respective sides of the sheet. The top end of the top pair of side hangers 252 and 253 as shown in FIG. 13 are spaced about 2 inches (5.08 centimeters) from the top edge of the sheet to accommodate the top hanger left in the opening after the damaged panel is removed. The side hangers 252 and 253 at each side have their adjacent ends, as shown in FIG. 13, spaced from one another to accommodate an intermediate hanger which is prehung in the opening.

After the damaged panel is removed, the side hangers 32 and 34 and intermediate hanger 38 and bottom hanger 30 of the damaged panel are removed. The opening is defined at its outer vertical sides by the outward extensions 58 and 60 of the vertical splines 54, at the lower horizontal ledge by the upward extension 104 of the horizontal spline 54 and at the horizontal top ledge by the top hanger 28 of the removed panel. The top hanger 28 of the removed panel is cleaned and a strip of double backed adhesive tape 125 is applied to the base 40 of the top hanger 28. An intermediate hanger 38 having a strip of the tape 125 is mounted on the intermediate horizontal furring 52 of the opening. Spacer blocks 112 are mounted on the ledge 110 (one only shown in FIG. 14) of the horizontal spline 54. As shown in FIG. 14, the bottom edge of the replacement panel 250 is angled inwardly to mount the exterior groove 48 of the bottom hanger 30 on the upper extension 104 of the horizontal spline 54. The replacement panel is then moved downward to rest on the spaced blocks j12 and biased toward the opening to adhere the adhesive tape of the top hanger 28 and intermediate hanger 38 to adjacent surface portion of the interior sheet surface 36.

Referring to FIG. 12, holes (not shown) are drilled through the extending portion of side hangers 252 and 253 and into the outside plate 204 of the underlying vertical spline 200. Thereafter, sheet metal screws 212 passing through the extending portions of the side hangers 252 and 253 are secured in the underlying plate 204 to mechanically secure the side hangers 252 and 253 to the vertical spline 200 of the cladding system. The screws are preferably on a center to center spacing of about 6 inches (15 centimeters).

A backer 127 is mounted between adjacent layers of silicone of the replacement panel and initially installed panel, i.e., around the sides and bottom edge of the replacement panel. A layer 124 of silicone is flowed into the spacing between sheet edges of adjacent panels and into the space between the top hanger and adjacent panel surface (see FIG. 9).

As now can be appreciated, the invention is not limited to the above examples, which are presented for illustration purposes only.

What is claimed is:

1. A glazing system for a building, comprising:
a grid having a plurality of openings;
means for securing said grid in a fixed position;
a plurality of panels;
means for securing said panels to said grid; and
wherein at least one of the panels includes:
a glass sheet having an inner surface facing said grid, and having a top edge, a bottom edge, a right side and a left side;
a first hanger secured to the inner surface of the sheet adjacent the bottom edge, said hanger having an outwardly facing groove;
a second hanger having a first edge portion and a second edge portion spaced from the first edge portion, and
means for securing the first edge on the inner surface of the sheet and having the second portion extending beyond a side edge of the sheet; and
wherein said means for securing said panels to said grid includes said outwardly facing groove of said first hanger of at least one of said panels mounted on a portion of said grid defining the opening and fastening means passing through the second portion of said second hanger and engages underlying portion of said grid defining the opening.

2. The glazing system as set forth in claim 1 wherein a third hanger is secured to the other side of the panel.

3. The glazing system as set forth in claim 1 wherein a second hanger is secured to inner surface of the panel at either of the right and left sides.

4. The glazing system as set forth in claim 1 wherein said outwardly facing groove is mounted on horizontal portion of said grid and said fastening means engages vertical portion of said grid.

5. The glazing system as set forth in claim 4 wherein said fastening means is a headed screw.

6. The glazing system as set forth in claim 5 wherein said grid has a ledge extending upwardly from said horizontal portion of said grid and said ledge receives the groove of the first hanger.

7. The glazing system as set forth in claim 6 wherein the first hanger further includes a groove facing in a direction opposite to the outer groove.

* * * * *